US008708209B2

(12) United States Patent
Oouchi

(10) Patent No.: US 8,708,209 B2
(45) Date of Patent: Apr. 29, 2014

(54) DRIVING TOOL

(75) Inventor: Haruhiko Oouchi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 519 days.

(21) Appl. No.: 13/032,418

(22) Filed: Feb. 22, 2011

(65) Prior Publication Data

US 2011/0240709 A1 Oct. 6, 2011

(30) Foreign Application Priority Data

Mar. 31, 2010 (JP) ..... 2010-080375

(51) Int. Cl.

| | |
|---|---|
| ***B21J 15/28*** | (2006.01) |
| ***B27F 7/17*** | (2006.01) |
| ***B25C 1/04*** | (2006.01) |
| ***B25C 5/02*** | (2006.01) |
| ***B25C 5/06*** | (2006.01) |

(52) U.S. Cl.

USPC ..... 227/8; 227/130

(58) Field of Classification Search

USPC ..... 173/47–48, 90, 141, 213; 227/8, 117, 227/147

See application file for complete search history.

(56) References Cited

U.S. PATENT DOCUMENTS

| | | | | |
|---|---|---|---|---|
| 4,227,637 | A * | 10/1980 | Haytayan | 227/8 |
| 4,346,831 | A * | 8/1982 | Haytayan | 227/8 |
| 7,490,747 | B2 * | 2/2009 | Kitagawa | 227/119 |
| 8,336,748 | B2 * | 12/2012 | Hlinka et al. | 227/8 |
| 2007/0194075 | A1 * | 8/2007 | Tanaka et al. | 227/8 |
| 2010/0012700 | A1 * | 1/2010 | Perron et al. | 227/8 |

FOREIGN PATENT DOCUMENTS

| | | | |
|---|---|---|---|
| JP | 2007-167986 | A | 7/2007 |

* cited by examiner

*Primary Examiner* — Robert Long
(74) *Attorney, Agent, or Firm* — Kilpatrick Townsend & Stockton LLP

(57) ABSTRACT

A driving tool includes a housing, a magazine, a cylinder head, a push lever, a cylinder, a combustion chamber frame, a piston, an injection part, and a fastener feeding unit. The housing has one end portion and another end portion. The magazine is connected to the housing and accommodating a fastener. The cylinder head is disposed at the one end portion. The push lever is movable relative to the housing upon pressure contacting a workpiece in a moving direction. The cylinder is fixed to the housing. The combustion chamber frame is movable in the housing in accordance with the push lever and selectively defining a combustion chamber in cooperation with the cylinder. The piston is slidably reciprocally movable relative to the cylinder and displaced upon expansion of air/fuel mixture in the combustion chamber. The injection part is connected to the another end portion of the housing and having an injection passage in communication with the magazine. The fastener feeding unit feeding the fastener to the injection passage in accordance with the movement of the push lever. The push lever includes a first guiding part configured to be slidably engaged with the fastener feeding unit. The fastener feeding unit is movable between an initial position and a feed position positioned downstream of the initial position in a feeding direction in which the fastener is fed. The fastener feeding unit slidably moves from the initial position to the feeding position with respect to the first guiding part for feeding the fastener downstream in the feeding direction in accordance with the movement of the push lever upon pressing the workpiece.

1 Claim, 8 Drawing Sheets

DRIVING TOOL

CROSS REFERENCE TO RELATED APPLICATION

This application claims priority from Japanese Patent Application No. 2010-080375 filed Mar. 31, 2010. The entire content of the priority application is incorporated herein by reference.

TECHNICAL FIELD

The present invention relates to a combustion type driving tool driving a fastener into a workpiece by using combustion and expansion of gas as a drive source.

BACKGROUND

A conventional driving tool drives a fastener such as a screw into a workpiece. For example, a driving tool disclosed in Japanese Patent Application Publication No. 2007-167986 drives a piston disposed in a cylinder by using a compressed air as a driving source. By the movement of the piston, a screw is driven into a workpiece. At the same time, a part of the compressed air is used as a driving source of a feed piston for feeding the fastener.

SUMMARY

However, if the above-described conventional structure using the part of driving source in order to feed the fastener is applied to a combustion type driving tool using the combustion and expansion of gas as the driving source for driving the fastener in the workpiece, a sufficient driving force to be applied to the feed piston for feeding the fastener can not be acquired because a temperature of the combustion gas decreases rapidly.

In view of the foregoing, it is an object of the present invention to provide a combustion type driving tool capable of stabilizingly feeding the fastener in conjunction with a movement of a push lever.

In order to attain the above and other objects, the invention provides a driving tool including a housing, a magazine, a cylinder head, a push lever, a cylinder, a combustion chamber frame, a piston, an injection part, and a fastener feeding unit. The housing has one end portion and another end portion. The magazine is connected to the housing and accommodating a fastener. The cylinder head is disposed at the one end portion. The push lever is movable relative to the housing upon pressure contacting a workpiece in a moving direction. The cylinder is fixed to the housing. The combustion chamber frame is movable in the housing in accordance with the push lever and selectively defining a combustion chamber in cooperation with the cylinder. The piston is slidably reciprocally movable relative to the cylinder and displaced upon expansion of air/fuel mixture in the combustion chamber. The injection part is connected to the another end portion of the housing and having an injection passage in communication with the magazine. The fastener feeding unit feeding the fastener to the injection passage in accordance with the movement of the push lever. The push lever includes a first guiding part configured to be slidably engaged with the fastener feeding unit. The fastener feeding unit is movable between an initial position and a feed position positioned downstream of the initial position in a feeding direction in which the fastener is fed. The fastener feeding unit slidably moves from the initial position to the feeding position with respect to the first guiding part for feeding the fastener downstream in the feeding direction in accordance with the movement of the push lever upon pressing the workpiece.

DETAILED DESCRIPTION

Figure 1:
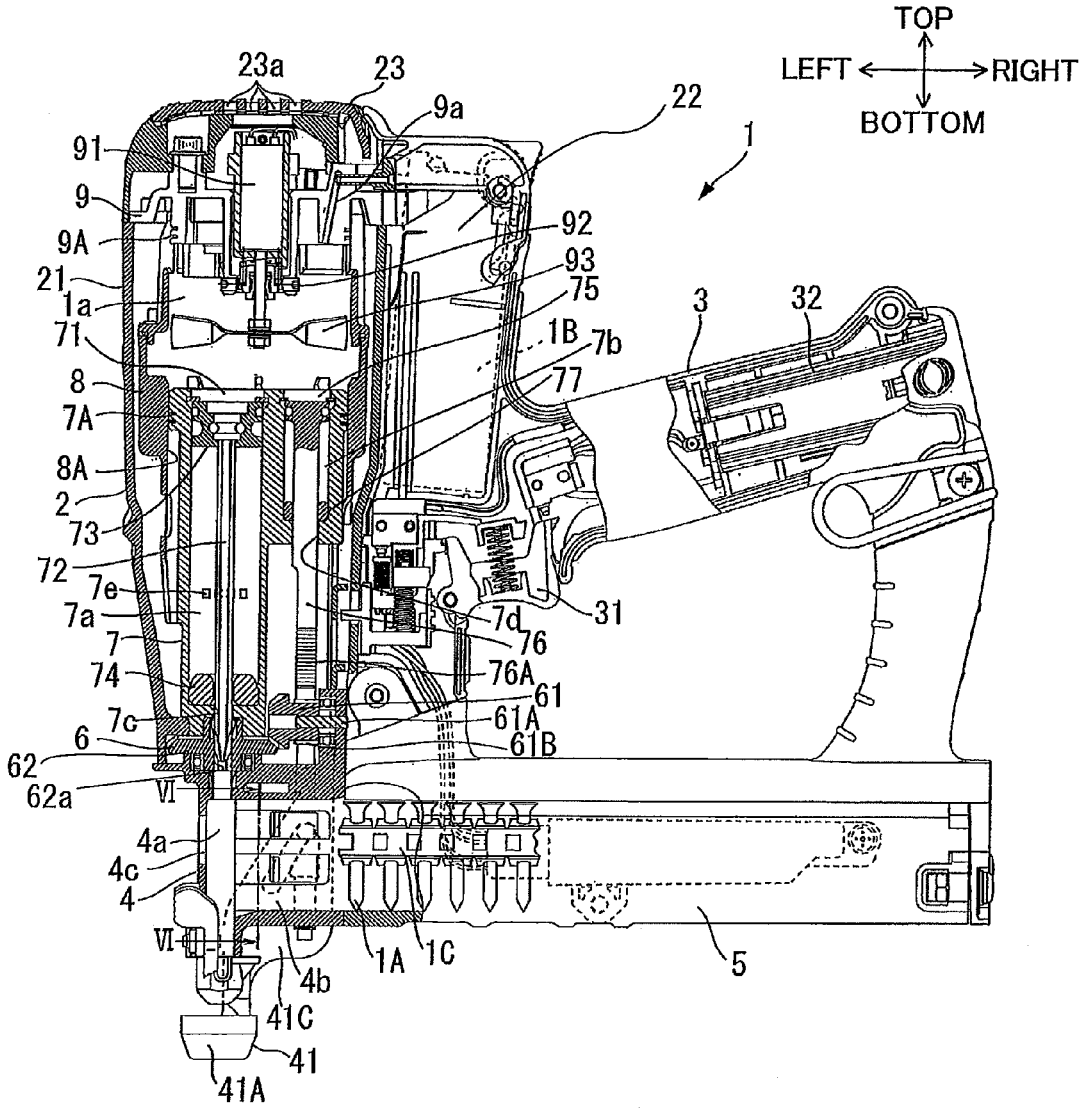
FIG. 1 is a partial cross-sectional view showing a combustion type driving tool according to an embodiment of the present invention.

A combustion type driving tool according to a first embodiment of the present invention will be described with reference to FIGS. 1 through 14. A driving tool 1 includes a housing 2, a handle 3, a nose part 4 (injection part), a magazine 5, and a motion conversion mechanism 6. Throughout the specification, a direction from the housing 2 to the nose part 4 will be referred to as a "downward direction", and its opposite direction will be referred to as an "upward direction". Further, a direction from the magazine 5 to the nose part 4 will be referred to as "leftward", and its opposite direction will be referred to as "rightward".

The housing 2 includes a main housing 21, a canister retaining portion 22, and a head cover 23. Within the main housing 21, a cylinder 7, a combustion chamber frame 8, and a cylinder head 9 are provided.

The cylinder 7 has a substantially cylindrical shape and defines a first cylinder chamber 7*a* and second cylinder chamber 7*b* therein. Each of first and second cylinder chamber 7*a* and 7*b* has a columnar shape. An upper outer peripheral portion of the cylinder 7 is provided with a seal portion 7A in intimate contact with an inner peripheral surface 8A of the combustion chamber frame 8. A spring (not shown) is provided at a lower portion of the cylinder 7 to bias the combustion chamber frame 8 downward (toward a bottom dead center). Each of the first cylinder chamber 7*a* and the second cylinder chamber 7*b* has an axis extending in a direction parallel to the upward/downward direction. The first cylinder chamber 7*a* has a volume larger than that of the second cylinder chamber 7*b*. The cylinder 7 has a first bottom part defining the first cylinder chamber 7*a*. The first bottom part has a bottom end portion formed with a bore 7*c*. An interior of the first cylinder chamber 7*a* is communicated with an exterior of the first cylinder chamber 7*a* via the bore 7*c* which allows a bit 72 (described later) to pass therethrough. The cylinder 7 has a second bottom part defining the second cylinder chamber 7*b*. The second bottom part has a bottom end portion formed with a bore 7*d*. An interior of the second cylinder chamber 7*b* is communicated with and an exterior of the second cylinder chamber 7*b* via the bore 7*d* which allows a rod 76 (described later) to pass therethrough.

A first piston 71, the bit 72, a supporting member 73, and a first bumper 74 are provided in the first cylinder chamber 7*a*. The first piston 71 is movable to a top dead center in which an upper surface of the first piston 71 is substantially flush with an upper end face of the cylinder 7. The first piston 71 has a generally circular disk shape and is in hermetic sliding contact with an inner peripheral surface of the cylinder 7 through a plurality of seal members, so that the first piston 71 divides the first cylinder chamber 7*a* into an upper chamber and a lower chamber.

The bit 72 has a rod shape having a regular hexagonal cross-section and extends in the downward direction. The bit 72 has a tip end portion (bottom end portion) portion shaped to be engageable with a head of screw. The tip end portion extends to an outside of the cylinder 7 through the bore 7*c*. The bit 72 has a base end portion (top end portion) connected to a lower end portion of the first piston 71 through the supporting member 73. The bit 72 is rotatable about its axis and is supported to the first piston 71 by the supporting member 73.

The first bumper 74 made from an elastic material such as rubber is disposed at an inside of the first cylinder chamber 7*a* and lower end portion of the first cylinder 7. Accordingly, direct abutment of the first piston 71 against a wall (first bottom part) of the cylinder 7 around the bore 7*c* can be prevented by the first bumper 74. Further, the first bumper 74 is adapted to absorb impact force of the first piston 71 when the first piston 71 drives a screw 1A described later. The abutment position between the first piston 71 and the first bumper 74 is a bottom dead center of the first piston 71.

In the lower portion of the first cylinder chamber 7*a*, the cylinder 7 is formed with a vent hole 7*e* communicating with an exhaust port (not shown) formed in the main housing 21 and penetrating from inside of the first cylinder chamber 7*a* to outside thereof. A check valve (not shown) is provided at the vent hole 7*e* to exclusively allow combustion gas to flow from an interior of the first chamber 7*a* to an exterior thereof. Further, an exhaust cover (not shown) is provided for covering the vent hole 7*e*.

A second piston 75, the rod 76, and a second bumper 77 are provided in the second cylinder chamber 7*b*. The second piston 75 is movable to a top dead center in which an upper surface of the second piston 75 is substantially flush with an upper end face of the cylinder 7. The upper surface of the second piston 75 has an area smaller than that of the first piston 71. By adjusting this area ratio, a ratio of a force for driving the screw 1A downward to a force for rotating the screw 1A can be suitably set. In this embodiment, the larger force for driving the screw 1A downward can be acquired by setting the area of the upper surface of the first piston 71 larger than that of the second piston 75. The second piston 75 has a substantial circular disk shape and is in hermetic sliding contact with an inner peripheral surface of the cylinder 7 through a plurality of seal members, so that the second piston 75 divides the second cylinder chamber 7*b* into an upper chamber and a lower chamber.

The rod 76 has a bottom end portion formed with a rack 76A having a predetermined length. The rack 76A is in meshing engagement with the motion conversion mechanism 6. The rod 76 extends to an outside of the second cylinder chamber 7*b* through the bore 7*d*. The rod 76 has an upper end portion fixed to a lower surface of the second piston 75.

The second bumper 77 made from an elastic material such as rubber is disposed in a lower portion of the second cylinder chamber 7*b*. Accordingly, direct abutment of the second piston 75 against a wall (second bottom part) of the cylinder 7 around the bore 7*d* can be prevented by the second bumper 77 when the second piston 75 moves downward. Further, the second bumper 77 is adapted to absorb impact force of the second piston 75 when the first piston 71 drives the screw 1A. The abutment position between the second piston 75 and the second bumper 77 is a bottom dead center of the second piston 75.

In the lower portion of the second cylinder chamber 7*b*, the cylinder 7 is formed with a vent hole (not shown) communicating with an exhaust port (not shown) formed in the main housing 21 and penetrating from inside of the second cylinder chamber 7*b* to outside thereof. A check valve (not shown) is provided at the vent hole (not shown) to exclusively allow the combustion gas to flow from an interior of the second chamber 7*b* to an exterior thereof. Further, an exhaust cover (not shown) is provided for covering the vent hole (not shown).

The combustion chamber frame 8 has a hollow cylindrical shape having open ends, and is disposed over the cylinder 7. The combustion chamber frame 8 is vertically reciprocally movable relative to the cylinder 7. The combustion chamber frame 8 has a lower end portion integrally provided with a link member (not shown) that is connected to the push lever 41. The combustion chamber frame 8 and the link member (not shown) are biased downward by a spring member (not shown) relative to the cylinder 7. The combustion chamber frame 8 has the inner peripheral surface 8A. The inner peripheral surface 8A is in hermetic contact with the seal portion 7A when the combustion chamber frame 8 is elevated against the biasing force of the spring (not shown). The inner peripheral surface 8A and seal portion 7A are adapted to maintain fluid-tightness between the combustion chamber frame 8 and the cylinder 7 when the combustion chamber frame 8 is elevated.

The cylinder head 9 is positioned at the upper side of the combustion chamber frame 8 and is fixed to the main housing 21. The cylinder head 9 has a lower portion provided with a seal portion 9A with which an upper inner peripheral surface portion of the combustion chamber frame 8 is in contact. Upon intimate contact with the seal portion 9A with the upper inner peripheral surface portion, a combustion chamber 1*a* is defined. More specifically, by the upward movement of the combustion chamber frame 8, the upper inner peripheral surface portion of the combustion chamber frame 8 is brought into intimate contact with the seal portion 9A, whereupon the combustion chamber 1*a* is defined by an upper surface of the first piston 71, the upper surface of the cylinder 7, the combustion chamber frame 8, and a lower surface of the cylinder head 9. The combustion chamber 1*a* can be fluid-tightly maintained because of the intimate contact between the seal portion 9A and the upper inner peripheral surface portion of the combustion chamber frame 8, and between the seal portion 7A and the inner peripheral surface of the combustion chamber frame 8.

The motion conversion mechanism 6 is positioned below the cylinder 7 and includes a first bevel gear 61 and a second bevel gear 62. The first bevel gear 61 has a shaft 61A rotatably supported to the main housing 2. A pinion 61B is provided on the shaft 61A and is meshingly engaged with the rack 76A of the rod 76. Movement of the rod 76 provides rotation of the pinion 61B meshed with the rack 76A to convert the linear movement of the rod 76 into rotational movement of the first bevel gear 61.

The second bevel gear 62 is disposed at the right side of the first bevel gear 61 and is rotatably supported in the nose part 4. The second bevel gear 62 is meshingly engaged with the first bevel gear 61. The rotation of the first bevel gear 61 is transmitted to the second bevel gear 62. The second bevel gear 62 has a rotation center formed with a hexagonal insertion hole 62*a* through which the bit 72 extends. The hexagonal insertion hole 62*a* has substantially the same shape as the outer shape of bit 72. Therefore, the bit 72 and the second bevel gear 62 are rotatable together coaxially with each other.

Upon movement of the rod 76 in the upward/downward direction, the pinion 61B meshed with the rack 76A is rotated. Rotation of the first bevel gear 61 is transmitted to the second bevel gear 62 meshed with the first bevel gear 61 so that the second bevel gear 62 rotates. Accordingly, the rotation of the second bevel gear 62 is transmitted to the bit 72 extending through the insertion hole 62*a* formed in the center of the second bevel gear 62.

The cylinder head 9 is formed with a fuel passage 9*a* for introducing combustible gas from a gas canister 1B into the combustion chamber 1*a*. A fan motor 91 and an ignition plug 92 are provided in the cylinder head 9. The fan motor 91 has a rotation shaft extending in a direction parallel to the upward/downward direction and protruding into the combustion chamber 1*a*. A head switch (not shown) is provided in the main housing 21 to detect an upper stroke end position of the combustion chamber frame 8 as a result of pushing the push lever 41 against the workpiece (not shown). The head switch (not shown) is rendered ON when the push lever 41 is elevated to a predetermined position whereupon rotation of the fan motor 91 will be started.

The fan 93 is mounted on a lower portion of the rotation shaft of the fan motor 91, and is exposed to the combustion chamber 1*a*. In a state where the combustion chamber frame 8 is in contact with the cylinder head 9, the rotation of the fan 93 promotes agitation between air and combustible gas, generates turbulent combustion upon ignition for promoting combustion, and discharges exhaust gas after combustion of the combustible gas out of the combustion chamber 1*a*.

The ignition plug 92 is disposed at the upper region of the combustion chamber 1*a* for igniting combustible gas supplied thereinto.

The head cover 23 is positioned at the upper portion of the main housing 21 and above the cylinder head 9. The head cover 23 is formed with a plurality of air intake ports 23*a*. A fresh air can be introduced into the combustion chamber 1*a* through the intake ports 23*a* by the rotation of the fan 93.

The gas canister retaining portion 22 is positioned on one side of the main housing 21 and extends in the upward/downward direction for retaining therein the gas canister 1B. The gas canister 1B accommodates therein the combustible gas and is configured to eject the combustible gas by a predetermined amount. The gas canister 1B is tiltable toward the cylinder head 9 in accordance with the movement of the push lever 41, and has a gas ejecting portion (not shown) in fluid communication with the fuel passage 9*a*. Accordingly, the combustible gas can be ejected into the combustion chamber 1*a* via the fuel passage 9*a* when the gas canister 1B is urged toward the main housing 21.

The handle 3 extends from the gas canister retaining portion 22 in a direction away from the main housing 21, and has a trigger 31 and a battery accommodating section 32. A battery (not shown) is detachably mounted on the battery accommodating section 32. The trigger 31 is adapted to supply electrical current to the ignition plug 92 provided at the cylinder head 9, upon pulling the trigger 31 to ignite the air/fuel mixture in the combustion chamber 1*a* to obtain the combustion and expansion of the air/fuel mixture.

The magazine 5 is positioned below the handle 3 and is generally aligned with the main housing 21 in the leftward/rightward direction. A plurality of screws 1A (fasteners) are arrayed inside the magazine 5 and are banded by a banding member 1C. The magazine 5 has an internal portion in communication with an injection passage 4*a* of the nose part 4.

The push lever 41 is disposed below the main housing 21 and is connected to the combustion chamber frame 8 via the link member (not shown). The push lever 41 includes a contact part 41A for contacting the workpiece (not shown), a connecting part 41B connected to the lower end portion of the combustion chamber frame 8, and a guiding part 41C connecting together the contact part 41A and the connecting part 41B.

The contact part 41A is adapted to contact the workpiece and is disposed to confront an injection passage 4*a* (FIG. 1). An upper end of the connecting part 41B is bent and connected to the combustion chamber frame 8 via a spring (not shown). The push lever 41 is biased downward by the biasing force of the spring (not shown). The guiding part 41C is a plate member extending in the upward/downward direction. The guiding part 41C includes a first guiding part 41D and a second guiding part 41E. The first guiding part 41D is formed with a first penetrating hole 41*a*. The second guiding part 41E is formed with a second penetrating hole 41*b*. The first penetrating hole 41*a* extends in a direction diagonally to the upward/downward direction such that a length in the upward/downward direction is equal to a stroke length of the push lever 41 and that a length in the leftward/rightward direction is equal to one pitch length of the screws 1A banded and arranged in the rightward/leftward direction. The first guiding part 41D includes a first regulating surface 41F and a second regulating surface 41G. The first regulating surface 41F defines a top edge of the first penetrating hole 41*a*. The second regulating surface 41G defines a bottom edge of the first penetrating hole 41*a*. A top edge of the second penetrating hole 41*b* is connected to the top edge of the first penetrating hole 41*a*. The second penetrating hole 41*b* has a length longer than or equal to the stroke length of the push lever 41 in the upward/downward direction. A fixing piece 41H for fixing a second spring described later (FIG. 3) is provided on a lower part of the guiding part 41C. The fixing piece 41H protrudes from the guiding part 41C toward a feeder 43 (FIG. 3) described later and is bent such that a distal end extends upward.

Figure 3:
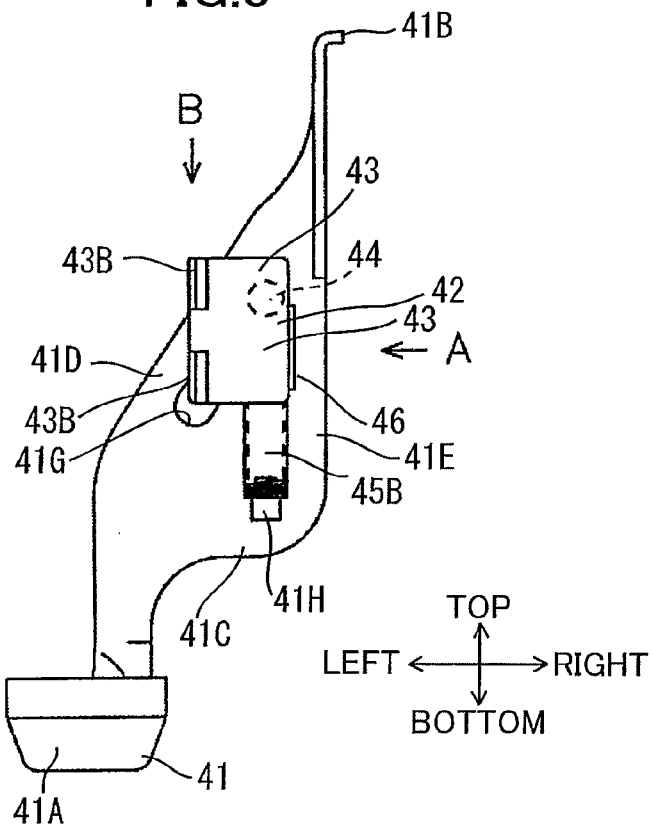
FIG. 3 is a front view of the push level and a fasten feeding mechanism (in an inactive state) in the combustion type driving tool according to the embodiment.
Figure 4:
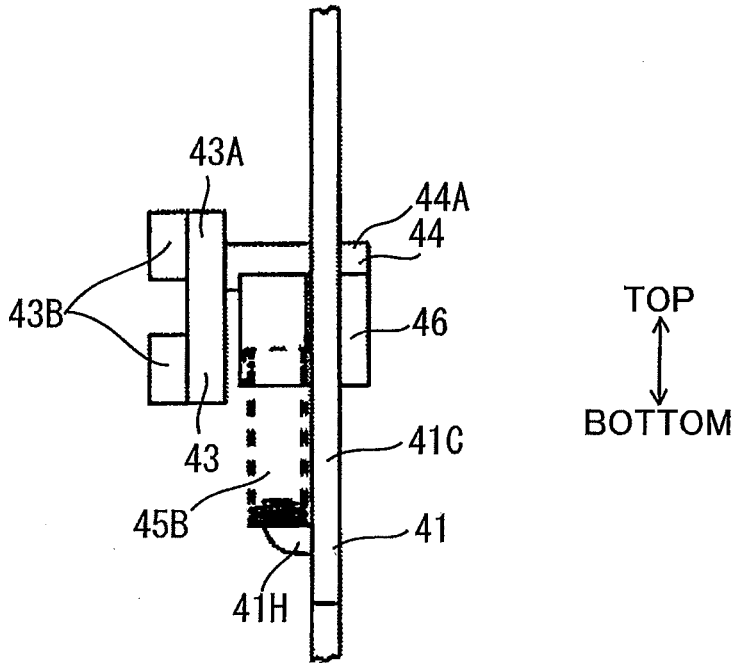
FIG. 4 is a right side view of the push level and the fasten feeding mechanism shown in FIG. 3 viewed in a direction indicated by an arrow A (in the inactive state) in the combustion type driving tool according to the embodiment.
Figure 5:
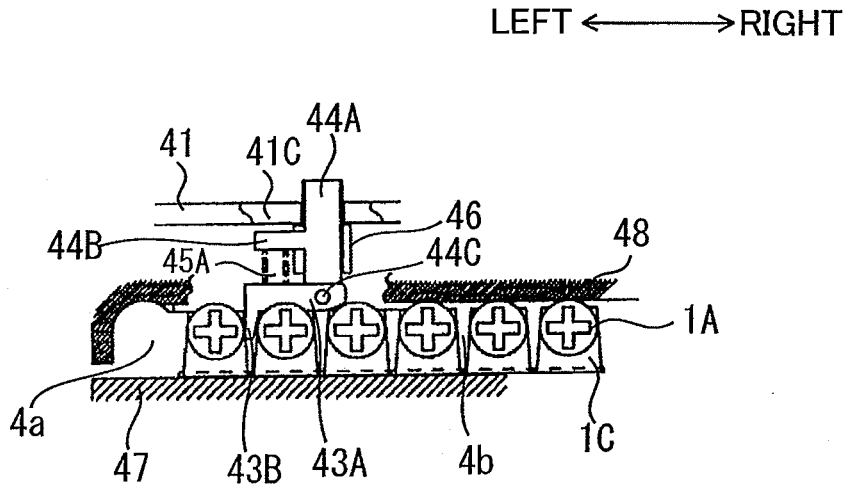
FIG. 5 is a top view of the push level and the fasten feeding mechanism shown in FIG. 3 as viewed in a direction indicated by an arrow B (in the inactive state) in the combustion type driving tool according to the embodiment.

As shown in FIGS. 3 through 5, the push lever 41 is provided with a fastener feed mechanism 42 as a fastener feeding unit. The fastener feed mechanism 42 includes the feeder 43, an arm 44 sliding along the guiding part 41C together with the feeder 43, a first spring 45A (FIG. 5), the second spring 45B, and a guiding member 46 (FIGS. 3 and 4).

The feeder 43 has a base portion 43A and two click portions 43B protruding from the base portion 43A in a direction away from the push lever 41. The base portion 43A is a plate member having a longitudinal direction parallel to the upward/downward direction and a widthwise direction parallel to the leftward/rightward direction. The base portion 43A is formed with a penetrating hole (not shown) penetrating in the upward/downward direction at one end portion thereof. The two click portions 43B are provided on another end portion of the base portion 43A and are arrayed in the upward/downward direction.

The arm 44 has a main portion 44A and a spring fixing portion 44B protruding from the main portion 44A in the leftward/rightward direction. The main portion 44A has a substantially cylindrical shape. The feeder 43 is supported to one end portion of the main portion 44A and is pivotably movable about a pin 44C when the pin 44C is inserted into the penetrating hole (not shown) formed in the one end portion of the feeder 43. Another end portion of the aim 44 is positioned in the first penetrating hole 41*a* and/or the second penetrating hole 41*b* and is engaged with the guiding part 41C of the push lever 41.

Figure 2:
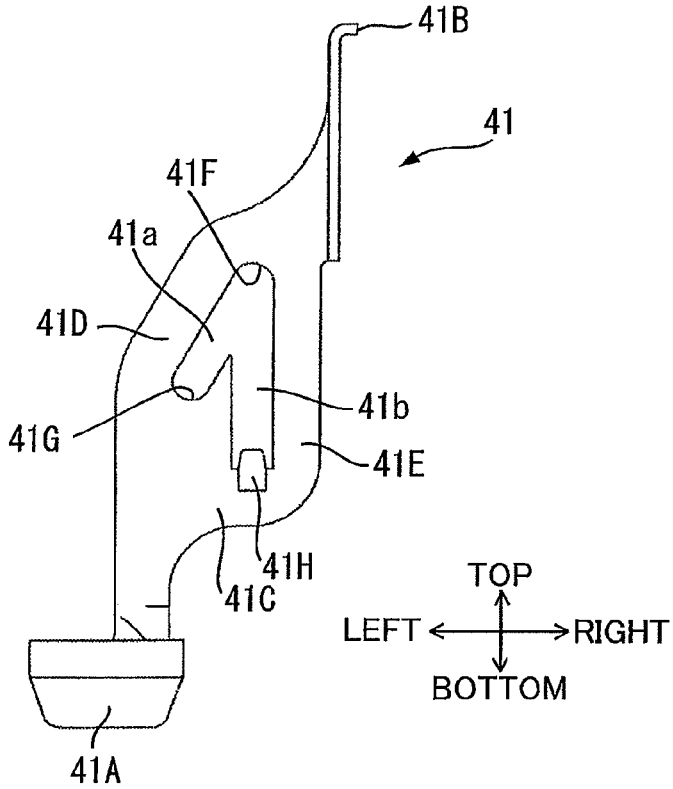
FIG. 2 is a front view of a push lever in the combustion type driving tool according to the embodiment.

In an inactive state where the push lever 41 is not pushed onto the workpiece, as shown in FIGS. 3 through 5, the main portion 44A is in contact with the first regulating surface 41F (FIG. 2). In the inactive state, the click portion 43B is located on the right side of the injection passage 4*a* such that a distance between the click portion 43B and the injection passage 4*a* is equal to one pitch length of the screws 1A that are banded in the leftward/rightward direction.

As shown in FIG. 5, the first spring 45A has one end connected to the spring fixing portion 44B and another end connected to the base portion 43A of the feeder 43. Accordingly, the first spring 45A biases the feeder 43 from the spring fixing portion 44B in a direction away from the push lever 41.

Figure 7:
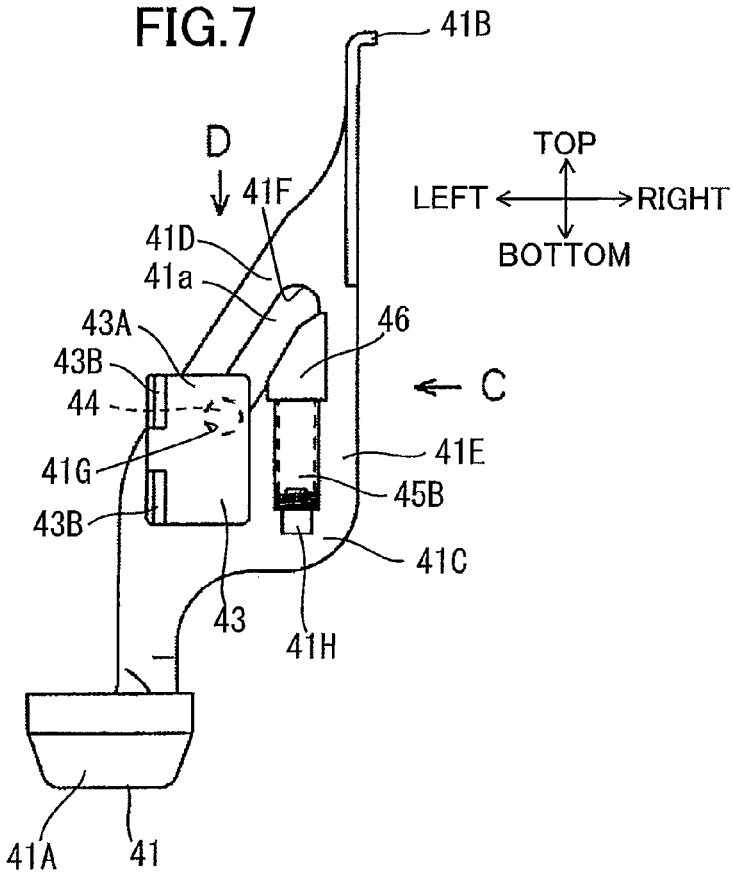
FIG. 7 is a front view of the push level and the fasten feeding mechanism (in a pressing state when a fastener has not been set) in the combustion type driving tool according to the embodiment.
Figure 8:
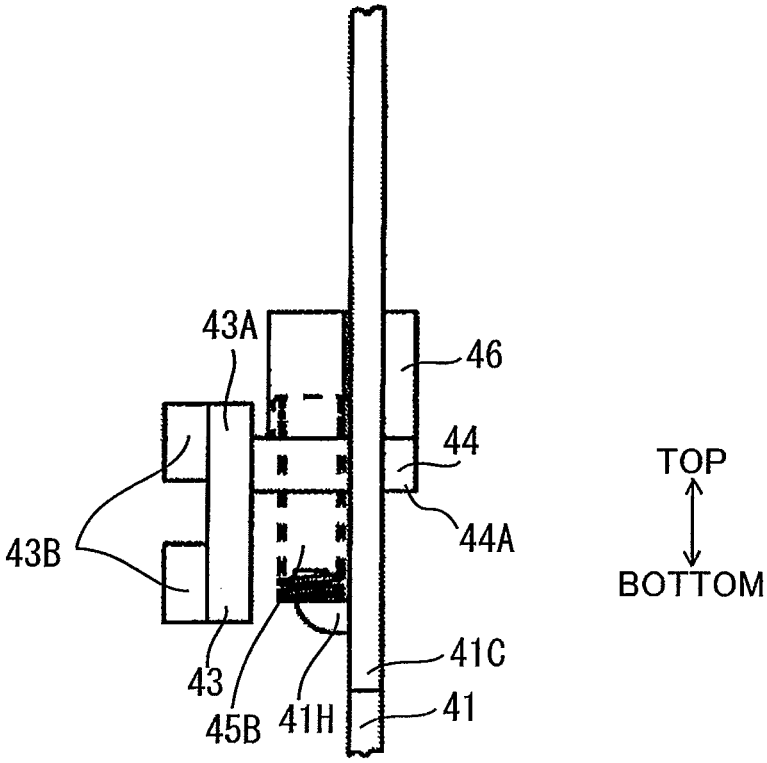
FIG. 8 is a right side view of the push level and the fasten feeding mechanism shown in FIG. 7 as viewed in a direction indicated by an arrow C (in the pressing state when a fastener has not been set) in the combustion type driving tool according to the embodiment.

As shown in FIG. 7, the guiding member 46 has a substantially rectangular triangle plate shape. A part of the guiding member 46 is located in the second penetrating hole 41*b* (FIG. 2) formed on the push lever 41 so that the guiding member 46 is movable along the second guiding part 41E. A lower end portion of the guiding member 46 is connected to the second spring 45B. The second spring 45B has an upper end connected to the guiding member 46 and a lower end connected to the fixing piece 41H. The second spring 45B biases the guiding member 46 upward. In the inactive state where the push lever 41 is not pushed onto the workpiece, as shown in FIG. 3, an oblique surface of the guiding member 46 defines a part of the first penetrating hole 41*a* when the oblique surface blocks an entrance of the second penetrating hole 41*b* at a position where the first penetrating hole 41*a* and the second penetrating hole 41*b* are connected. In this state, the oblique surface supports the arm 44 such that the arm 44 is engaged with the first regulating surface 41F (FIG. 2). When the push lever 41 is elevated, the guiding member 46 guides the arm 44 toward the second regulating surface 41G in the first penetrating hole 41*a*

Figure 6:
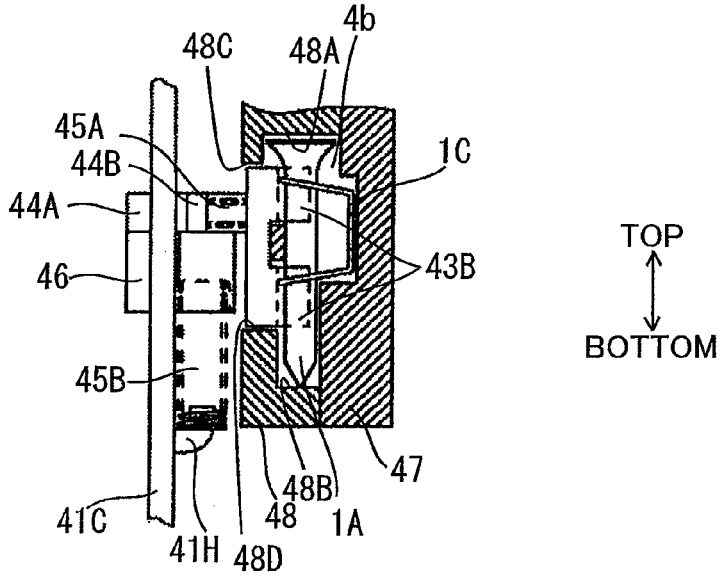
FIG. 6 is an enlarged cross-sectional view taken along the line VI-VI of FIG. 1.

The nose part 4 extends from a lower end of the main housing 2. As shown in FIG. 6, the nose part 4 includes a guiding side wall 47 and a supporting side wall 48. The guiding side wall 47 guides the banded screws 1A in the leftward/rightward direction. The supporting side wall 48 supports the feeder 43. The guiding side wall 47 and supporting side wall 48 define an accommodating space 4*b* for accommodating the banded screws 1A. Further, the guiding side wall 47 is provided with a projection (not shown) preventing the screw 1A from moving rightward.

Figure 9:
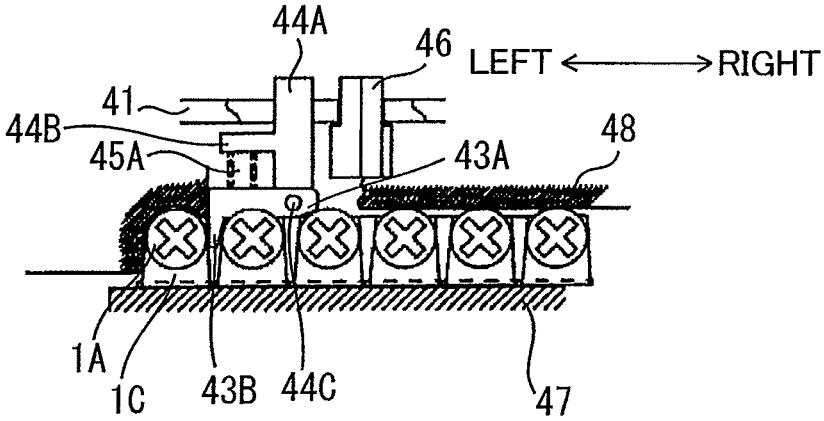
FIG. 9 is a top view of the push level and the fasten feeding mechanism shown in FIG. 7 as viewed in a direction indicated by an arrow D (in the pressing state when a fastener has been not set) in the combustion type driving tool according to the embodiment.

The supporting side wall 48 has an upper surface 48A and a lower surface 48B that prevent the banded screws 1A from moving in the upward/downward direction. The supporting side wall 48 further has a first supporting surface 48C and a second supporting surface 48D that prevent the feeder 43 from moving in the upward/downward direction with respect to the main housing 21. A distance between the first supporting surface 48C and the second supporting surface 48D is substantially equal to a length of the feeder 43 in the upward/downward direction. The first supporting surface 48C and second supporting surface 48D support the feeder 43 to slidably move between an initial position (FIG. 5) and a feed position (FIG. 9). The feed position is a position shifted from the initial position in the leftward direction (downstream of feeding the screw 1A) for one pitch of the banded screws 1A. Further, as shown in FIG. 1, the nose part 4 is formed with a passage 4*c* at a left end portion thereof. A part of the band member 1C corresponding to the screw 1A that has been driven into the workpiece is discharged outside of the nose part 4 via the passage 4*c*.

Operation of the driving tool 1 will next be described. In a non-operational phase as shown in FIGS. 1 through 5, since the combustion chamber frame 8 is connected to the push lever 41 via the link member (not shown), the upper end of the combustion chamber frame 8 is separated from the cylinder head 9. Accordingly, the first vent hole (not shown) is defined between the upper end of the combustion chamber frame 8 and the cylinder head 9. The first piston 71 and the second piston 75 are positioned at their top dead center. Further, the second vent hole (not shown) is defined between the seal portion 7A and the combustion chamber frame 8. The push lever 41 is biased downward by the biasing force of the spring (not shown), so that the tip end of the push lever 41 is positioned downward of the nose part 4. The feeder 43 and the arm 44 is positioned at the initial position shown in FIGS. 3 through 5 by the guiding part 41C, the guiding member 46, and the second spring 45B. The click portions 43B contacts to a right side of the leading screw 1A.

When a user grips the handle 3 and pushes the push lever 41 against the workpiece in the this state, the push lever 41 is moved upward against the biasing force of the spring (not shown) and the combustion chamber frame 8 is moved upward via the link member (not shown). By the upward movement, the upper end of the combustion chamber frame 8 is brought into abutment with the cylinder head 9 so as to hermetically provide the combustion chamber 1*a*.

Further, in accordance with movement of the push lever 41, the gas canister 1B is tilted toward the cylinder head 9, so that combustible gas accumulated in the gas canister 1B will be ejected once into the combustion chamber 1*a* through the fuel passage 9*a*.

When the combustion chamber frame 8 reaches its stroke end in accordance with the movement of the push lever 41, the fan switch (not shown) is turned ON to start electrical power supply to the fan motor 91, thereby starting rotation of the fan 93. Accordingly, combustible gas introduced into the combustion chamber 1*a* can be agitatingly mixed with fresh air.

In this state, in accordance with the movement of the push lever 41 upward, the arm 44 relatively moves downward and leftward with respect to the push lever 41 in the first penetrating hole 41*a*. Specifically, when the screw 1A has not been disposed in the injection passage 4*a*, the feeder 43 and arm 44 are guided by the guiding member 46, engaged with the first guiding part 41D, and move from the first regulating surface 41F to the second regulating surface 41G. Since the first supporting surface 48C and the second supporting surface 48D (FIG. 6) prevent the feeder 43 from moving in the upward/downward direction, the feeder 43 moves rightward for one pitch of the banded screws 1A and does not move in the upward/downward direction with respect to the main housing 21. By moving the feeder 43 from the initial position to the feed position, the click portions 43B press and feed the leading screw 1A to the injection passage 4*a* (FIG. 5).

Then, when the trigger 31 is turned ON, the ignition plug 92 in the combustion chamber 1*a* is ignited, thereby igniting, combusting, and exploding the air/fuel mixture. Because of the combustion and explosion, the first piston 71 and the bit 72 are moved downward until the first piston 71 abuts against the first bumper 74. Further, the second piston 75 and the rod 76 are moved downward until the second piston 75 abuts against the second bumper 77. After elapsing a predetermined time period, the rack 76A starts to engage with the pinion 61B because the rod 76 is formed with the rack 76A upward for a prescribed distance from a point where the rack 76A and the second pinion 61B are engaged with each other as shown in FIG. 1. More specifically, the rack 76A is formed in a position so that the rack 76A and the pinion 61B are engaged with each other after the screw 1A contacts the workpiece. Accordingly, the rotational force is transmitted to the bit 72 via the motion conversion mechanism 6 after the screw 1A contacted to the workpiece. Therefore, the screw 1A is rotationally driven into the workpiece.

The combustion gas remaining in the cylinder 7 and the combustion chamber 1*a* has high temperature, and therefore, the combustion heat will be absorbed thereinto through the inner surfaces of the cylinder 7 and the combustion chamber frame 8. Thus, temperature of the cylinder 7 and the combustion chamber frame 8 will be increased. The heat is then released to the atmosphere through the outer surfaces of the cylinder 7 and the combustion chamber frame 8.

Because of the heat absorption into the cylinder 7, the combustion gas is promptly cooled to decrease a volume thereof. Accordingly, pressure in the upper chamber of the first cylinder chamber 7*a* will be decreased to become a pressure not more than the atmospheric pressure to cause a thermal vacuum. As a result, the first piston 71 can be returned to its initial top dead center position. The same is true with respect to the second cylinder chamber 7*b*, so that the second piston 75 is returned to its top dead center position because of the thermal vacuum.

Figure 10:
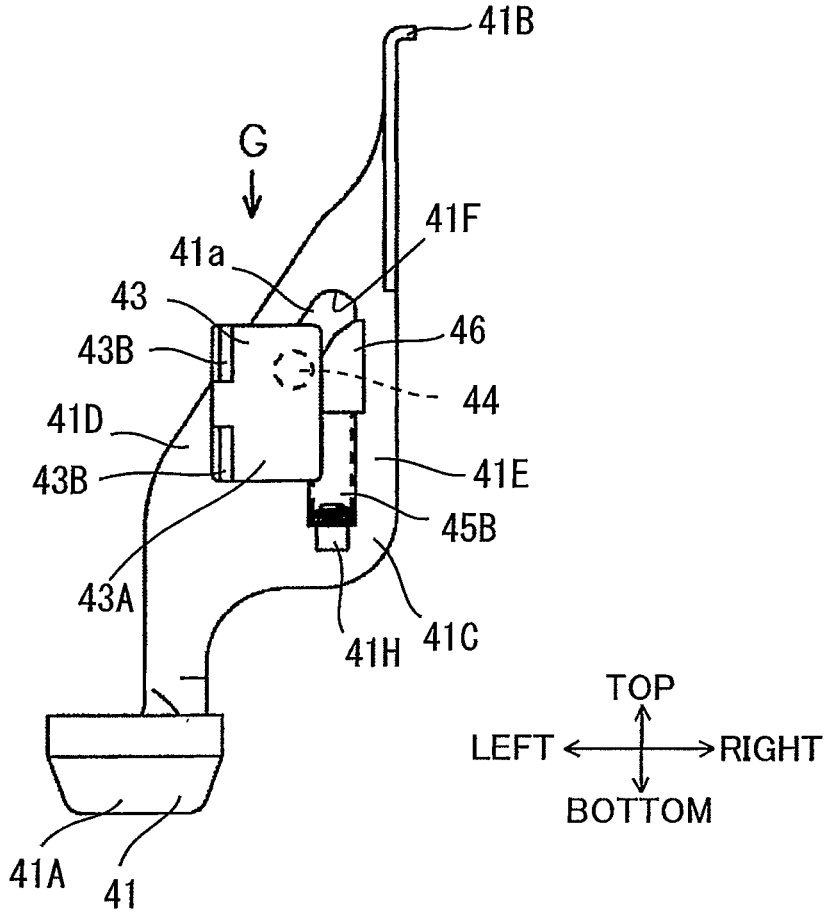
FIG. 10 is a front view of the push level and the fasten feeding mechanism (in a state after the fastener is driven in a workpiece) in the combustion type driving tool according to the embodiment.
Figure 11:
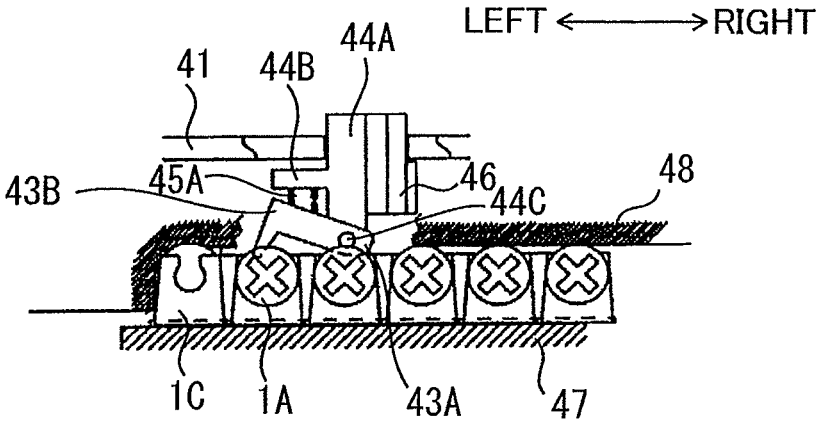
FIG. 11 is a top view of the push level and the fasten feeding mechanism shown in FIG. 10 as viewed in a direction indicated by an arrow G (in the state after the fastener is driven in a workpiece) in the combustion type driving tool according to the embodiment.

Then the trigger 31 is rendered OFF, and the user lifts the driving tool 201 in its entirety to separate the push lever 41 from the surface of the workpiece. As a result, the push lever 41 and the combustion chamber frame 8 are returned to its position shown in FIG. 1 because of the biasing force of the spring (not shown). In accordance with downward movement of the push lever 41, the feeder 43 and the arm 44 are guided by the first guiding part 41D and move in the first penetrating hole 41*a* from the second regulating surface 41G (FIG. 2) to the first regulating surface 41F as shown in FIGS. 10 and 11. Since the first supporting surface 48C and the second supporting surface 48D (FIG. 6) prevent the feeder 43 from moving in the upward/downward direction, the feeder 43 and the arm 44 move from the feed position to the initial position in the leftward/rightward direction with respect to the main housing 21. The projection (not shown) of the guiding side wall 47 prevents the banded screws 1A from moving rightward. Therefore, when the arm 44 moves from the feed position to the initial position, the feed 43 pivots about the pin 44C against the biasing force of the first spring 45A such that the click portions 43B contacts an outer surface of the screw 1A to be driven subsequently. Accordingly, the feeder 43 is positioned on the right side of next screw 1A (upstream side in a direction for conveying the screws), that is, the feeder 43 is disposed at the initial position so as to feed the next screw 1A.

Then, the head switch is rendered OFF at a timing elapsing from a prescribed time period. However, the fan 93 continues rotation for a predetermined period of time. Because of the rotation of the fan 93, air flow can be generated. That is, fresh air is introduced from the air intake ports 23*a* into the combustion chamber 1*a* through the vent hole (not shown), and the air and the residual combustion gas can be discharged through the exhaust port (not shown) of the main housing 21. Accordingly, scavenging can be performed with respect to the combustion chamber 1*a*. Then, rotation of the fan 93 is stopped to provide an initial stationary phase. Then, the above-described operation will be repeatedly performed for successively driving the screw 1A into the workpiece. When the next screw 1A to be driven subsequently is fed, the part of the band member 1C corresponding to the screw 1A that has been driven into the workpiece is discharged outside of the nose part 4 via the passage 4*c* (FIG. 1).

Figure 12:
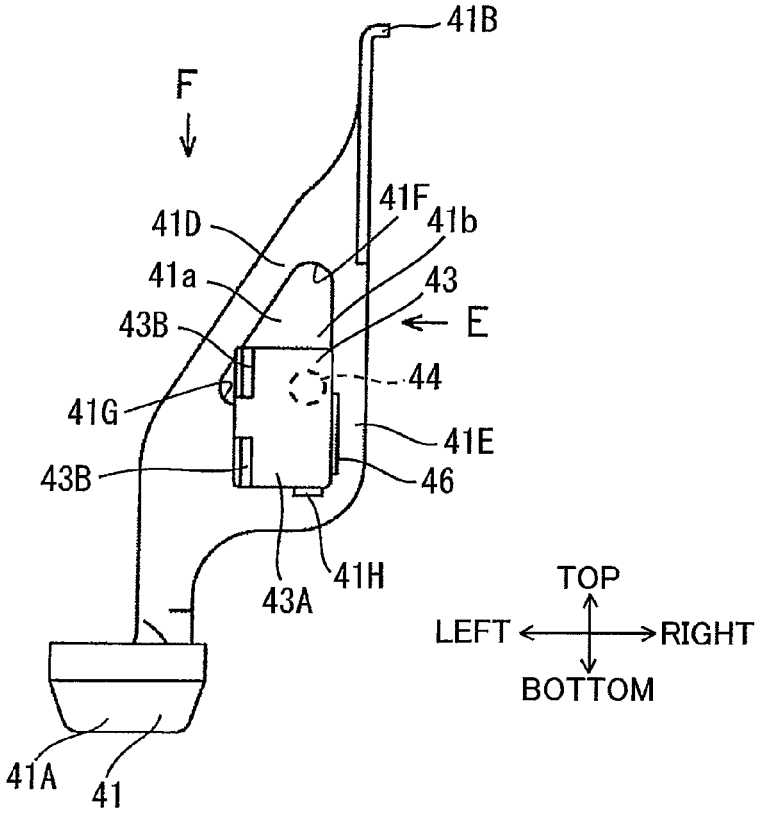
FIG. 12 is a front view of the push level and the fasten feeding mechanism (in a pressing state where the fastener is set) in the combustion type driving tool according to the embodiment.
Figure 13:
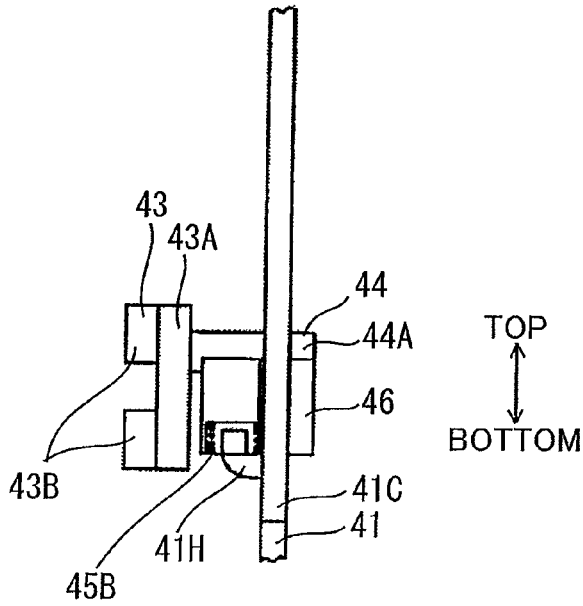
FIG. 13 is a right side view of the push level and the fasten feeding mechanism shown in FIG. 12 as viewed in a direction indicated by an arrow E (in the pressing state where the fastener is set) in the combustion type driving tool according to the embodiment.
Figure 14:
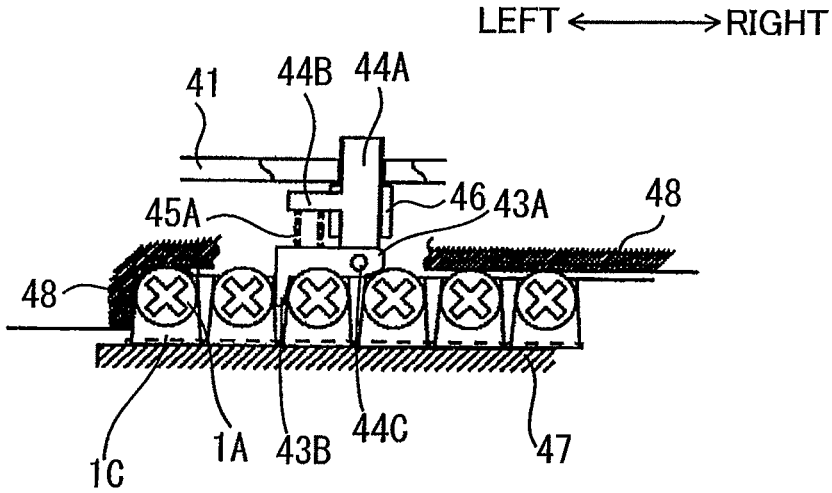
FIG. 14 is a top view of the push level and the fasten feeding mechanism shown in FIG. 12 as viewed in a direction indicated by an arrow F (in the pressing state when the fastener is set) in the combustion type driving tool according to the embodiment.

Further, when the push lever 41 moves upward in a state where the screw 1A has been disposed in the injection passage 4*a*, as shown in FIGS. 12 through 14, the screw 1A prevents the feeder 43 and the arm 44 from moving in the leftward/rightward direction. Accordingly, the arm 44 moves in the second penetrating hole 41*b* against the biasing force of the second spring 45B while pressing the guiding member 46 downward. That is, the arm 44 is guided by the second guiding part 41E and moves downward with respect to the push lever 41. Since the first supporting surface 48C and the second supporting surface 48D (FIG. 6) prevents the feeder 43 in the upward/downward direction, the feeder 43 remains at the initial position and does not feed the screw 1A.

When the push lever 41 moves downward after the driving operation is completed, the arm 44 is biased by the second spring 45B, and is guided by the second guiding part 41E, and moves in the second penetrating hole 41*b* toward the first regulating surface 41F. Then, the arm 44 is disposed at the initial position and contacts the first regulating surface 41F as shown in FIGS. 3 through 5.

In the driving tool 1 described above, the screw 1A is fed to the injection passage 4*a* of the nose part 4 in accordance with the movement of the push lever 41 in the upward/downward direction. Accordingly, the driving tool 1 can feed the screw 1A in the injection passage 4*a* at a timing at which the combustion chamber 1*a* is defined. Therefore, the screw 1A is stabilizingly fed and positioned in the injection passage 4*a* when the driving tool 1 starts a driving operation. Further, simple driving tool for feeding the screw 1A can be provided without a separate mechanism for supplying compressed air.

Further, when the screw 1A has been disposed in the injection passage 4*a*, the feeder 43 does not move downstream in the conveying direction of the screw 1A (leftward) in accordance with the movement of the push lever 41 in the upward/downward direction. With this structure, it is possible to prevent two screws from choking at the injection passage 4*a*. Therefore, the breakage of the bit 72 can be prevented. Further, breakages of the nose part 4, the fastener feed mechanism 42, the push lever 41, and the like due to forcible feeding of the screw 1A can be prevented.

While the invention has been described in detail with reference to the embodiment thereof, it would be apparent to those skilled in the art that various changes and modifications may be made therein without departing from the spirit of the invention. For example, the feeder 43 of the fastener feed mechanism 42 may be supported to the magazine 5. Further, the magazine may be a roll-type magazine.

What is claimed is:

1. A driving tool comprising:

a housing having a first end portion and a second end portion;

a magazine connected to the housing and accommodating a fastener;

a cylinder head disposed at the first end portion;

a push lever movable relative to the housing upon pressure contacting a workpiece in a moving direction;

a cylinder fixed to the housing;

a combustion chamber frame movable in the housing in accordance with the push lever and defining a combustion chamber in cooperation with the cylinder when the cylinder head contacts the combustion chamber frame;

a piston slidably reciprocally movable relative to the cylinder and displaced upon expansion of air/fuel mixture in the combustion chamber;

an injection part connected to the second end portion of the housing and having an injection passage in communication with the magazine; and a fastener feeding unit feeding the fastener to the injection passage in accordance with the movement of the push lever;

wherein the push lever includes a first guiding part configured to be slidably engaged with the fastener feeding unit; a second guiding part extending in the moving direction and connecting the first guiding part, the fastener feeding unit configured to be slidably engaged with the second guiding part; and a supporting unit supporting the fastener feeding unit such that the fastener feeding unit is engaged with the first guiding part when a fastener has not been disposed in the injection passage and the fastener feeding unit is engaged with the second guiding part when a fastener has been disposed in the injection passage; and wherein the fastener feeding unit is movable between an initial position and a feed position positioned downstream of the initial position in a feeding direction in which the fastener is fed;

wherein the fastener feeding unit slidably moves from the initial position to the feeding position with respect to the first guiding part for feeding the fastener downstream in the feeding direction in accordance with the movement of the push lever upon pressing the workpiece; and wherein when the fastener has been disposed in the injection passage, the fastener feeding unit slidably moves relative to the second guiding part in accordance with the movement of the second guiding part by the movement of the push lever upon pressing the workpiece to maintain the fastener feeding unit at the initial position.

* * * * *